US009044948B2

(12) United States Patent
Kato et al.

(10) Patent No.: US 9,044,948 B2
(45) Date of Patent: Jun. 2, 2015

(54) LIQUID DISCHARGE HEAD SUBSTRATE, LIQUID DISCHARGE HEAD, AND METHOD OF MANUFACTURING LIQUID DISCHARGE HEAD SUBSTRATE

(71) Applicant: CANON KABUSHIKI KAISHA, Tokyo (JP)

(72) Inventors: Maki Kato, Fuchu (JP); Takahiro Matsui, Yokohama (JP); Ichiro Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/185,760

(22) Filed: Feb. 20, 2014

(65) Prior Publication Data

US 2014/0240402 A1 Aug. 28, 2014

(30) Foreign Application Priority Data

Feb. 22, 2013 (JP) ..... 2013-033647

(51) Int. Cl.
*B41J 2/05* (2006.01)
*B41J 2/16* (2006.01)
*B41J 2/14* (2006.01)

(52) U.S. Cl.
CPC ..... *B41J 2/1648* (2013.01); *B41J 2/14129* (2013.01); *B41J 2202/03* (2013.01)

(58) Field of Classification Search
CPC ..... B41J 2/1631; B41J 2/1628; B41J 2/1642; B41J 2/1643; B41J 2/1404; B41J 2/14016; B41J 2/1408; B41J 2/14088; B41J 2/14129; B41J 2/14; B41J 2002/03; B41J 2002/14387; B41J 2/33525; B41J 2/3353; B41J 2/335; B41J 2/315
See application file for complete search history.

(56) References Cited

U.S. PATENT DOCUMENTS

| | | | | |
|---|---|---|---|---|
| 6,527,813 | B1 * | 3/2003 | Saito et al. | 347/62 |
| 2009/0315956 | A1 * | 12/2009 | Ishida et al. | 347/63 |
| 2012/0001971 | A1 * | 1/2012 | Matsui et al. | 347/10 |

FOREIGN PATENT DOCUMENTS

| | | | | |
|---|---|---|---|---|
| JP | 05-301345 | * | 11/1993 | B41J 2/05 |
| JP | 5-301345 | A | 11/1993 | |
| JP | 2007-269011 | * | 10/2007 | B41J 2/05 |
| JP | 2007-269011 | A | 10/2007 | |

* cited by examiner

*Primary Examiner* — Geoffrey Mruk
(74) *Attorney, Agent, or Firm* — Canon USA Inc. IP Division

(57) ABSTRACT

A liquid discharge head substrate includes a base; a pair of wiring lines; a heat-generating resistive layer, which is in contact with the wiring lines, and which has a portion corresponding to a space between the wiring lines, the portion forming an electrothermal transducer; an insulating layer which covers the heat-generating resistive layer and the wiring lines and which contains Si; a protective layer which covers at least one region of the insulating layer which contains Ir; and an intermediate layer which is placed between the insulating layer and the protective layer. The intermediate layer contains a material represented by the formula $Ta_xSi_yN_z$, where x is 5 atomic percent to 80 atomic percent, y is 3 atomic percent to 60 atomic percent, z is 10 atomic percent to 60 atomic percent.

4 Claims, 5 Drawing Sheets

LIQUID DISCHARGE HEAD SUBSTRATE, LIQUID DISCHARGE HEAD, AND METHOD OF MANUFACTURING LIQUID DISCHARGE HEAD SUBSTRATE

BACKGROUND OF THE INVENTION

1. Field of the Invention

The present invention relates to a liquid discharge head for discharging a liquid, a liquid discharge head substrate for use in such a liquid discharge head, and a method of manufacturing the liquid discharge head substrate.

2. Description of the Related Art

A inkjet head is one of general liquid discharge heads and includes a plurality of discharge ports, a channel communicating with the discharge ports, and a plurality of electrothermal transducers generating thermal energy used to discharge ink. Each electrothermal transducer includes a heat-generating resistor and electrodes for supplying electricity to the heat-generating resistor. The electrothermal transducer is covered with an insulating protective layer (insulating layer) having electrical insulation properties and therefore the insulation between the electrothermal transducer and ink is ensured. The electrothermal transducers, which are arranged in the inkjet head, are selectively driven, whereby thermal energy is generated from the driven electrothermal transducers. Ink on ink contact sections (heating sections) located above the electrothermal transducers is rapidly heated and therefore bubbles are generated, whereby ink is discharged.

Heating sections of the inkjet head are heated to high temperature by the heat-generating resistors and undergo physical actions such as impact due to the bubbling of ink or cavitation caused by shrinkage and chemical actions due to ink. In order to protect the electrothermal transducers from the influences of the physical and chemical actions, an upper protective layer is placed above the electrothermal transducers (on the ink side). The upper protective layer is made of a metal material, such as a platinum group metal (Ir, Ru, or the like) or Ta, resistant to impact due to cavitation and chemical actions due to ink. In particular, a film of a platinum group metal such as Ir or Ru is highly resistant to impact due to cavitation and is superior in view of the reliably and extended life-span of inkjet heads.

In order to increase the adhesion between the upper protective layer and the insulating protective layer, an intermediate layer is placed therebetween so as to serve as an adhesive layer. Japanese Patent Laid-Open No. 5-301345 discloses that Cr, Ti, V, W, Hf, Zr, Nb, or Mo is used to form an adhesive layer. Japanese Patent Laid-Open No. 2007-269011 discloses that Ti or TaN is used to form an adhesive layer.

However, if the upper protective layer is fatigued by impact due to cavitation and therefore is cracked, then ink may possibly enter cracks. Therefore, when the intermediate layer is made of Cr, Ti, V, W, Hf, Zr, Nb, or Mo as disclosed in Japanese Patent Laid-Open No. 5-301345 or is made of Ti as disclosed in Japanese Patent Laid-Open No. 2007-269011, the intermediate layer is oxidized by the ink entering the cracks. This swells the intermediate layer and therefore an Ir film placed on the intermediate layer is pushed from the intermediate layer side; hence, the durability of the Ir film is reduced and therefore the life span of the electrothermal transducers may possibly be reduced.

On the other hand, TaN is a material excellent in oxidation resistance as disclosed in Japanese Patent Laid-Open No. 2007-269011. In order to achieve high-definition printing recently required, electrothermal transducers are densely arranged and therefore an intermediate layer needs to have a small size. However, when the intermediate layer has a small area, the intermediate layer is much likely to be peeled from an insulating protective layer.

SUMMARY OF THE INVENTION

The present invention provides a liquid discharge head substrate in which the oxidation of an intermediate layer placed between an insulating layer and a protective layer is suppressed and in which the adhesion between the insulating layer and the protective layer is excellent, a liquid discharge head, and a method of manufacturing the liquid discharge head substrate.

A liquid discharge head substrate includes a base; a pair of wiring lines placed on or above the base; a heat-generating resistive layer which is placed on or above the base, which is in contact with the wiring lines, and which has a portion corresponding to a space between the wiring lines, the portion forming an electrothermal transducer; an insulating layer which covers the heat-generating resistive layer and the wiring lines and which contains Si; a protective layer which covers at least one region of the insulating layer that corresponds to the electrothermal transducer and which contains Ir; and an intermediate layer which is placed between the insulating layer and the protective layer and which is in contact with the insulating layer and the protective layer. The intermediate layer contains a material represented by the formula $Ta_xSi_yN_z$, where x is 5 atomic percent to 80 atomic percent, y is 3 atomic percent to 60 atomic percent, z is 10 atomic percent to 60 atomic percent, and the sum of x, y, and z is 100 atomic percent.

According to the above configuration, the following head and substrate can be provided: a liquid discharge head and a liquid discharge head substrate in which the oxidation of an intermediate layer is suppressed and the adhesion between an insulating layer and a protective layer is excellent.

Further features of the present invention will become apparent from the following description of exemplary embodiments with reference to the attached drawings.

DESCRIPTION OF THE EMBODIMENTS

Embodiments of the present invention will now be described in detail on the basis of examples below. The present invention is not limited to the examples. Effects of the present invention may be achieved.

Figure 1A:
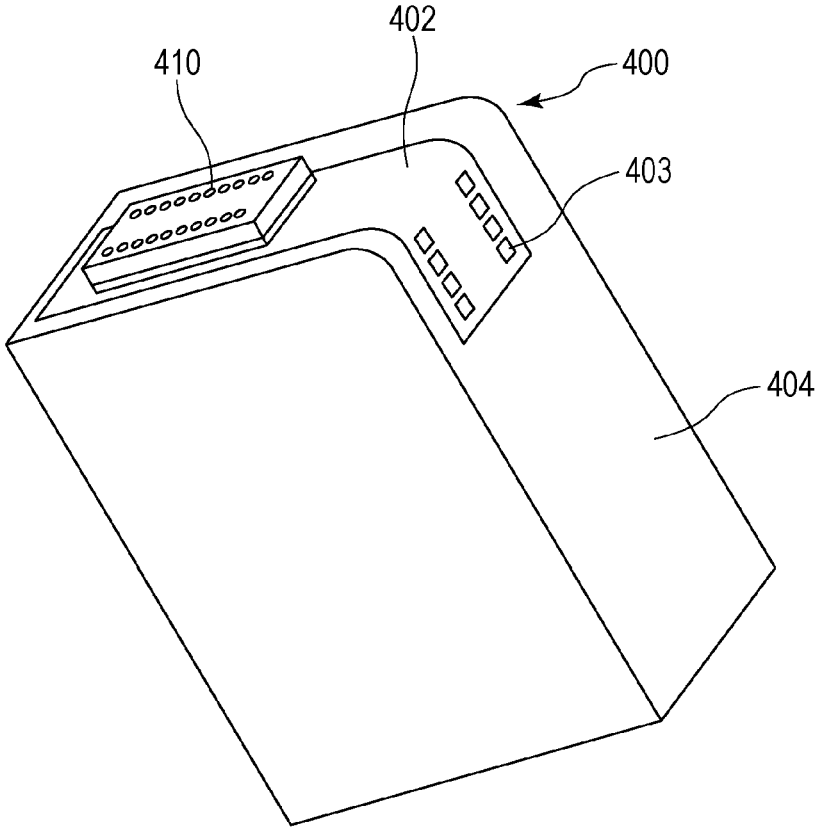
FIG. 1A is a schematic perspective view of an inkjet head unit.
Figure 1B:
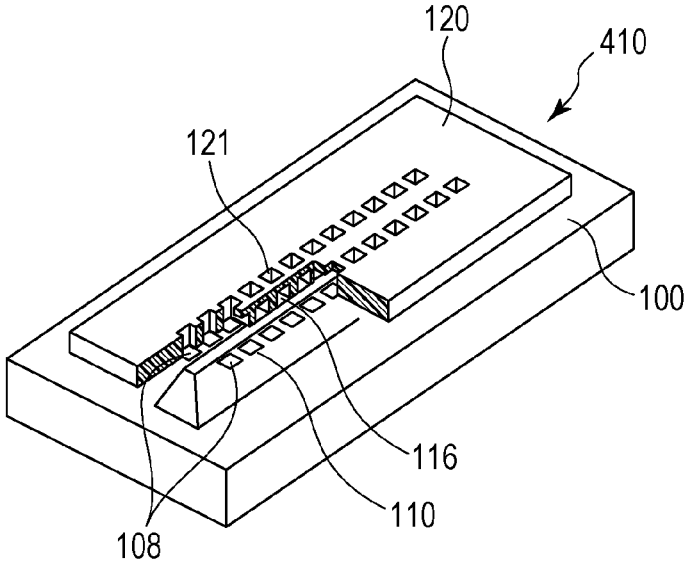
FIG. 1B is a schematic perspective view of an inkjet head according to an embodiment of the present invention.

FIG. 1A is a schematic perspective view of an inkjet head unit 400. FIG. 1B is a schematic perspective view of an inkjet head 410 corresponding to a liquid discharge head according to an embodiment of the present invention.

As shown in FIG. 1A, the inkjet head unit 400 is a cartridge type of unit including the inkjet head 410 and an ink tank 404 combined therewith. The inkjet head unit 400 is detachably placed in a carriage attached to an inkjet printing apparatus. The inkjet head unit 400 includes the ink tank 404. The ink tank 404 temporarily stores ink and supplies the stored ink to the inkjet head 410. The inkjet head unit 400 may be configured such that the inkjet head 410 and the ink tank 404 are separate from each other.

A tape member 402, including terminals for supplying electricity, for tape automated bonding (TAB) is attached to the inkjet head unit 400. The inkjet head 410 is supplied with electricity from the inkjet printing apparatus through pads 403 placed on the tape member 402 and wiring lines extending in the tape member 402.

Figure 4:
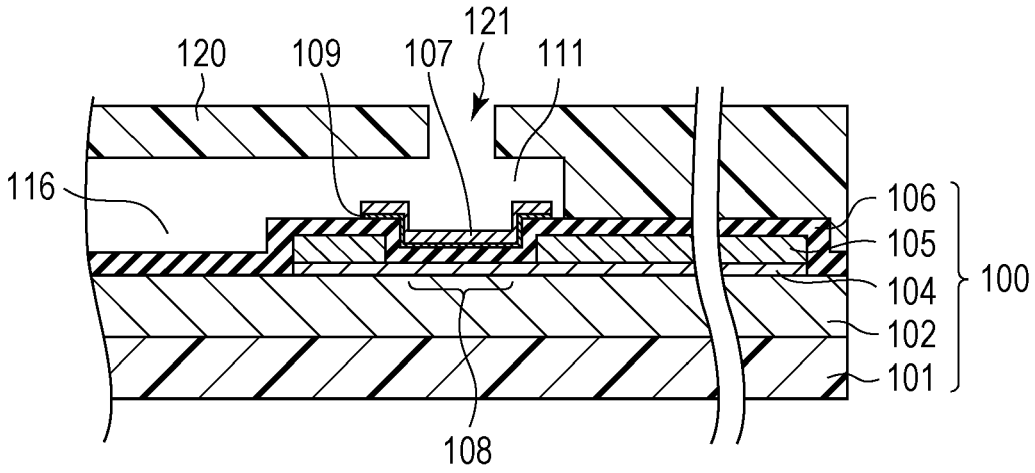
FIG. 4 is a schematic perspective view of an inkjet head according to an embodiment of the present invention.

As shown in FIG. 1B, the inkjet head 410 includes an inkjet head substrate 100 (liquid discharge head substrate) and a discharge port member 120. The inkjet head substrate 100 includes a plurality of electrothermal transducers 108 and has ink supply ports 110 for supplying ink to the electrothermal transducers 108. When being energized, the electrothermal transducers 108 generate thermal energy to generate bubbles in ink for the purpose of discharging ink. The discharge port member 120 has a plurality of ink discharge ports 121 for discharging ink. The ink discharge ports 121 are placed at positions corresponding to the electrothermal transducers 108. The discharge port member 120 is made of a resin material such as an epoxy resin. The inkjet head substrate 100 and the discharge port member 120 form a pressure chamber 111 in which the electrothermal transducers 108 are placed as shown in FIG. 4 and also form a channel 116 communicating with the ink supply ports 110 and the pressure chamber 111.

Figure 2A:
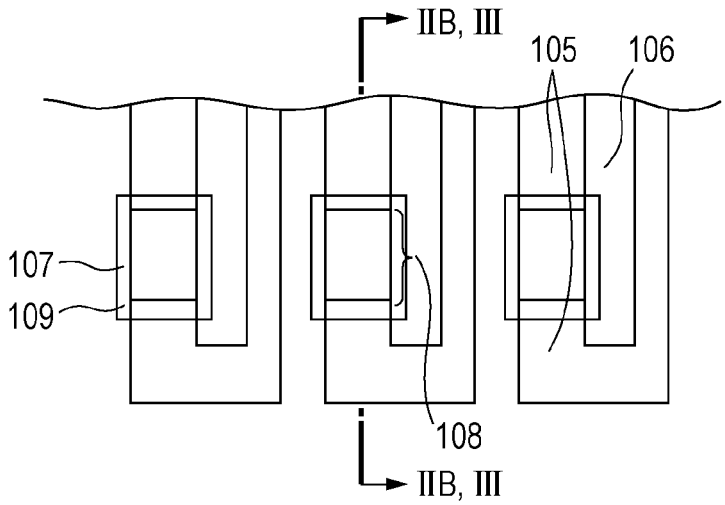
FIG. 2A is schematic plan view of an inkjet head substrate according to an embodiment of the present invention.
Figure 2B:
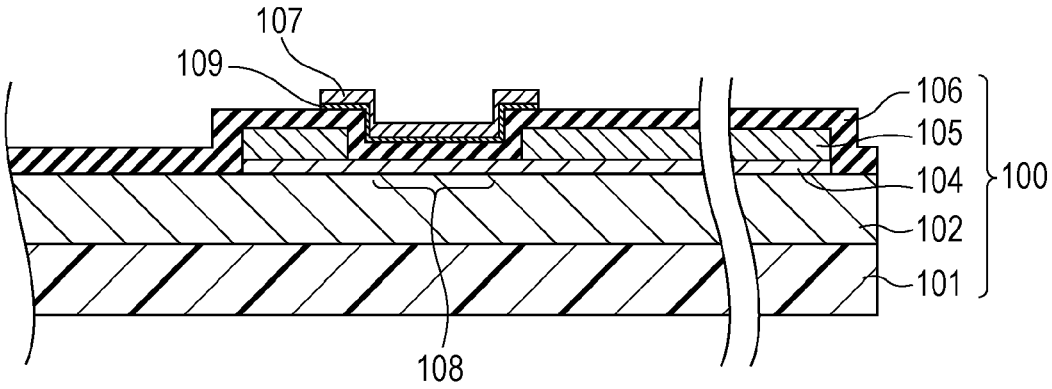
FIG. 2B is a schematic sectional view of the inkjet head substrate taken along the line IIB-IIB of FIG. 2A.

FIG. 2A is a schematic plan view of a portion of the inkjet head substrate 100, the portion being located close to the electrothermal transducers 108. FIG. 2B is a schematic sectional view of the inkjet head substrate 100 taken along the line IIB-IIB of FIG. 2A. This embodiment is further described in detail with reference to these figures.

Referring to FIG. 2B, reference numeral 101 denotes a base made of silicon; reference numeral 102 denotes a heat storage layer including a $SiO_2$ film, a SiN film, or the like; reference numeral 104 denotes heat-generating resistive layers made of TaSiN or the like; and reference numeral 105 denotes electrode wiring layers, serving as wiring lines made of a metal material such as Al, Al—Si, or Al—Cu. The electrothermal transducers 108 serve as heating sections. Each of the electrothermal transducers 108 includes a portion of a corresponding one of the heat-generating resistive layers 104, the portion being exposed through a gap between a pair of wiring lines formed by partly removing the electrode wiring layers 105. The electrode wiring layers 105 are connected to a drive element circuit or external power supply terminals, which are not shown, and can be supplied with electricity from outside.

The electrothermal transducers 108 may be formed in such a way that the electrode wiring layers 105 are formed on the base 101 or the heat storage layer 102, gaps are formed by partly removing the electrode wiring layers 105, and the heat-generating resistive layers 104 are provided on the electrode wiring layers 105.

Referring to FIG. 2B, reference numeral 106 denotes an insulating protective layer (insulating layer); reference numeral 107 denotes upper protective layers (protective layer) for protecting the electrothermal transducers 108 from chemical actions due to ink and physical impacts such as bubbling, shrinkage, and bubbling; and reference numeral 109 denotes adhesive layers (intermediate layers) for ensuring the adhesion between the insulating protective layer 106 and the upper protective layers 107. The insulating protective layer 106 is placed over the electrothermal transducers 108 and the electrode wiring layers 105 (on the pressure chamber 111 side) and is made of an insulating material such as SiN or SiCN. The upper protective layers 107 are placed over regions corresponding to the electrothermal transducers 108. The upper protective layers 107 are preferably made of a metal material and more preferably a platinum group material, such as Ir, Ru, or Pt, excellent in resistance to impact due to cavitation.

A method of manufacturing the inkjet head substrate 100 is described below.

FIGS. 3A to 3D are sectional views showing steps of manufacturing the inkjet head substrate 100 taken along the line IIB-IIB of FIG. 2A.

The base 101 is subjected to steps below in such a state that the base 101 includes a driving circuit including semiconductor devices, such as switching transistors, for selectively driving the electrothermal transducers 108 or includes no driving circuit. For the sake of convenience, the base 101 including no driving circuit is shown in figures below.

Figure 3A:
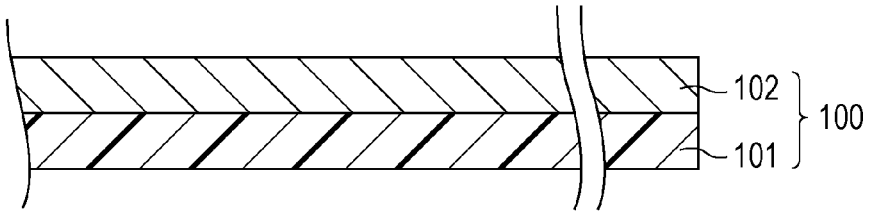
FIGS. 3A to 3D are schematic sectional views illustrating steps of manufacturing the inkjet head substrate shown in FIG. 2A.

As shown in FIG. 3A, the heat storage layer 102 is formed on the base 101 by a thermal oxidation process, a sputtering process, a chemical vapor deposition (CVD) process, or the like in the form of a lower layer for the heat-generating resistive layers 104 so as to include a $SiO_2$ thermal oxide film. The heat storage layer 102 may be formed in a step of fabricating the driving circuit.

The heat-generating resistive layers 104 are formed on the heat storage layer 102 by reactive sputtering using TaSiN so as to have a thickness of about 50 nm. An Al layer for forming the electrode wiring layers 105 is formed over the heat-generating resistive layers 104 by sputtering so as to have a thickness of about 300 nm. The heat-generating resistive layers 104 and the Al layer are dry-etched together by photolithography. The dry etching used in this embodiment is a reactive ion etching (RIE) process.

Figure 3B:
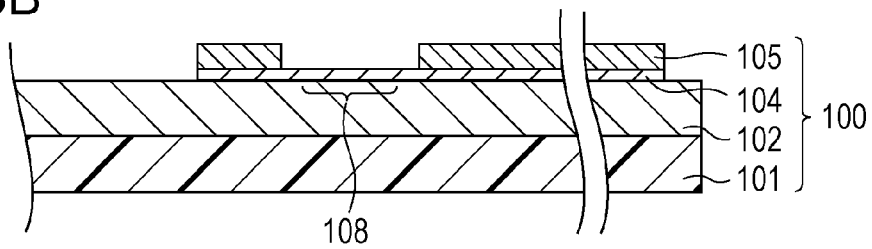

As shown in FIG. 3B, the Al layer is partly removed by wet etching using photolithography such that the electrode wiring layers 105 are formed and the heat-generating resistive layers 104 are exposed between the electrode wiring layers 105, whereby the electrothermal transducers 108 are formed.

Figure 3C:
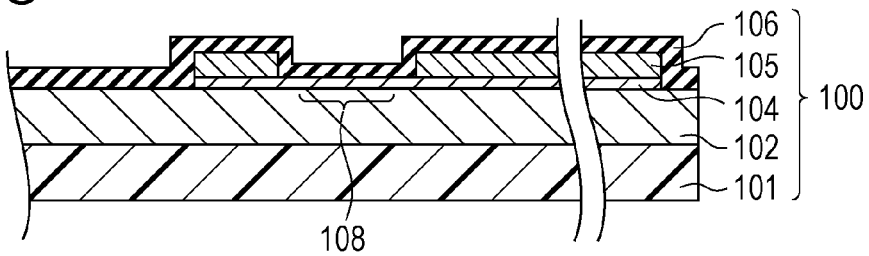

As shown in FIG. 3C, the insulating protective layer 106 is formed by a plasma-enhanced chemical vapor deposition (PECVD) process using SiN or SiCN as to have a thickness of about 350 nm.

Figure 3D:
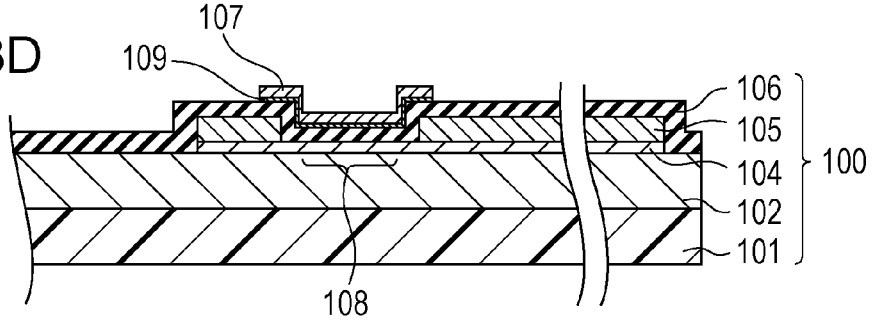

A $Ta_xSi_yN_z$ film for forming the adhesive layers 109 is formed on the insulating protective layer 106 by a sputtering process so as to have a thickness of about 50 nm, where $x+y+z=100$ (atomic percent). Herein, the content of each element in the $Ta_xSi_yN_z$ film is expressed in atomic percent. An Ir film for forming the upper protective layers 107 is formed on the $Ta_xSi_yN_z$ film by a sputtering process so as to have a thickness of about 50 nm. As shown in FIG. 3D, the $Ta_xSi_yN_z$ film and the Ir film are partly removed by dry etching using photolithography, whereby the upper protective layers 107 and the adhesive layers 109 are formed near the electrothermal transducers 108. In this way, the inkjet head substrate 100 is manufactured.

Thereafter, the discharge port member 120, which is made of an epoxy resin, is provided on the inkjet head substrate 100 such that the pressure chamber 111 and the channel 116 are formed, whereby the inkjet head 410 is manufactured as shown in FIG. 4.

EXAMPLES

Examples 1 to 10

Inkjet heads 410 were manufactured by the method described in the above embodiment. In particular, each $Ta_xSi_yN_z$ film for forming adhesive layers 109 was formed on an insulating protective layer 106, made of SiN, having a Si content of 50 atomic percent and a N content of 50 atomic percent so as to have a composition shown in Table 1. An Ir film for forming upper protective layers 107 was formed on the $Ta_xSi_yN_z$ film. The inkjet heads 410 were obtained through subsequent steps.

Examples 11 to 20

Inkjet heads 410 were manufactured by the method described in the above embodiment. In particular, each $Ta_xSi_yN_z$ film for forming adhesive layers 109 was formed on an insulating protective layer 106 made of SiCN so as to have a composition shown in Table 1. An Ir film for forming upper protective layers 107 was formed on the $Ta_xSi_yN_z$ film. The inkjet heads 410 were obtained through subsequent steps. The insulating protective layers 106 had a Si content of 40 atomic percent to 50 atomic percent, a C content of 10 atomic percent to 20 atomic percent, and a N content of 40 atomic percent to 50 atomic percent, the sum of the Si content, the C content, and the N content being 100 atomic percent or less.

Comparative Examples 1 to 7

Inkjet heads 410 were manufactured in substantially the same way as that used in Examples 1 to 10 except that adhesive layers 109 were formed using $Ta_xSi_yN_z$ so as to have compositions shown in Table 1.

Comparative Examples 8 to 14

Inkjet heads 410 were manufactured in substantially the same way as that used in Examples 11 to 20 except that adhesive layers 109 were formed using $Ta_xSi_yN_z$ so as to have compositions shown in Table 1.

The inkjet heads 410 manufactured in Examples 1 to 20 and Comparative Examples 1 to 14 were filled with a pigment-containing ink with a pH of about 8.5, were subjected to a discharge durability test, and were electrically checked at constant intervals, whereby the durability thereof was evaluated. In the discharge durability test, three nozzles placed in each inkjet head substrate 100 were checked in such a way that voltage pulses were applied to electrothermal transducers 108 at a k-value of 1.14, a driving voltage of 24 V, and a driving frequency of 15 kHz, the k-value being defined as the ratio of the minimum voltage to generate bubbles to the driving voltage.

The inkjet heads 410 manufactured in Comparative Examples 1 to 14 did not perform normal discharge when the number of voltage pulses applied to the inkjet heads 410 manufactured in Comparative Examples 1 to 14 reached about half the number of voltage pulses applied to the inkjet heads 410 manufactured in Examples 1 to 20.

After being subjected to the discharge durability test, all the inkjet heads 410 were disassembled and were then observed with a scanning electron microscope (SEM). The following items were evaluated by this observation: (1) the oxidation state of the adhesive layers 109, (2) the adhesion between the adhesive layers 109 and the upper protective layers 107 (Ir films), and (3) the adhesion between the adhesive layers 109 and the insulating protective layers 106 (SiN or SiCN films).

Table 1 shows results obtained by applying $1\times10^9$ voltage pulses to all the inkjet heads 410. Table 2 shows results obtained by applying $2\times10^9$ voltage pulses to the inkjet heads 410 manufactured in Examples 1 to 20. For the inkjet heads 410 that did not perform discharge during testing, the number of voltage pulses applied thereto is shown in Tables 1 and 2.

For the oxidation state of the adhesive layers 109, one in which none of three tested sites was oxidized was judged to be good, one in which one of three tested sites was oxidized was judged to be adequate, and one in which two or more of three tested sites were oxidized was judged to be poor. For the adhesion between the adhesive layers 109 and the upper protective layers 107 or the adhesion between the adhesive layers 109 and the insulating protective layers 106, one in which none of three tested sites was peeled off was judged to be good, one in which one of three tested sites was peeled off was judged to be adequate, and one in which two or more of three tested sites were peeled off was judged to be poor.

TABLE 1

| | Adhesive layers | | | Insulating protective | $1\times10^9$ pulses | | | |
|---|---|---|---|---|---|---|---|---|
| | x | y | z | layer | Results of discharge durability test (Number of pulses in undischarged case) | Oxidation state of adhesive layers | Adhesion between adhesive layers and upper protective layers | Adhesion between adhesive layers and insulating protective layer |
| Example 1 | 40 | 30 | 30 | SiN | Good | Good | Good | Good |
| Example 2 | 80 | 10 | 10 | | Good | Good | Good | Good |
| Example 3 | 80 | 3 | 17 | | Good | Good | Good | Good |
| Example 4 | 37 | 3 | 60 | | Good | Good | Good | Good |
| Example 5 | 5 | 35 | 60 | | Good | Good | Good | Good |
| Example 6 | 5 | 60 | 35 | | Good | Good | Good | Good |
| Example 7 | 30 | 60 | 10 | | Good | Good | Good | Good |
| Example 8 | 60 | 20 | 20 | | Good | Good | Good | Good |
| Example 9 | 40 | 10 | 50 | | Good | Good | Good | Good |
| Example 10 | 20 | 50 | 30 | | Good | Good | Good | Good |
| Example 11 | 40 | 30 | 30 | SiCN | Good | Good | Good | Good |
| Example 12 | 80 | 10 | 10 | | Good | Good | Good | Good |
| Example 13 | 80 | 3 | 17 | | Good | Good | Good | Good |
| Example 14 | 37 | 3 | 60 | | Good | Good | Good | Good |

TABLE 1-continued

| | Adhesive layers | | | Insulating protective | 1 × $10^9$ pulses | | | |
|---|---|---|---|---|---|---|---|---|
| | x | y | z | layer | Results of discharge durability test (Number of pulses in undischarged case) | Oxidation state of adhesive layers | Adhesion between adhesive layers and upper protective layers | Adhesion between adhesive layers and insulating protective layer |
| Example 15 | 5 | 35 | 60 | | Good | Good | Good | Good |
| Example 16 | 5 | 60 | 35 | | Good | Good | Good | Good |
| Example 17 | 30 | 60 | 10 | | Good | Good | Good | Good |
| Example 18 | 60 | 20 | 20 | | Good | Good | Good | Good |
| Example 19 | 40 | 10 | 50 | | Good | Good | Good | Good |
| Example 20 | 20 | 50 | 30 | | Good | Good | Good | Good |
| Comparative Example 1 | 94 | 3 | 3 | SiN | 5 × $10^8$ | Poor | Good | Good |
| Comparative Example 2 | 60 | 0 | 40 | | 7 × $10^8$ | Good | Good | Adequate |
| Comparative Example 3 | 20 | 10 | 70 | | 7 × $10^8$ | Good | Adequate | Adequate |
| Comparative Example 4 | 0 | 40 | 60 | | 5 × $10^8$ | Good | Poor | Good |
| Comparative Example 5 | 10 | 80 | 10 | | 5 × $10^8$ | Good | Poor | Good |
| Comparative Example 6 | 15 | 65 | 20 | | 7 × $10^8$ | Good | Adequate | Good |
| Comparative Example 7 | 50 | 45 | 5 | | 5 × $10^8$ | Poor | Good | Good |
| Comparative Example 8 | 94 | 3 | 3 | SiCN | 5 × $10^8$ | Poor | Good | Good |
| Comparative Example 9 | 60 | 0 | 40 | | 7 × $10^8$ | Good | Good | Adequate |
| Comparative Example 10 | 20 | 10 | 70 | | 7 × $10^8$ | Good | Adequate | Adequate |
| Comparative Example 11 | 0 | 40 | 60 | | 5 × $10^8$ | Good | Poor | Good |
| Comparative Example 12 | 10 | 80 | 10 | | 5 × $10^8$ | Good | Poor | Good |
| Comparative Example 13 | 15 | 65 | 20 | | 7 × $10^8$ | Good | Adequate | Good |
| Comparative Example 14 | 50 | 45 | 5 | | 5 × $10^8$ | Poor | Good | Good |

TABLE 2

| | Adhesive layers | | | Insulating protective | 2 × $10^9$ pulses | | | |
|---|---|---|---|---|---|---|---|---|
| | x | y | z | layer | Results of discharge durability test (Number of pulses in undischarged case) | Oxidation state of adhesive layers | Adhesion between adhesive layers and upper protective layers | Adhesion between adhesive layers and insulating protective layer |
| Example 1 | 40 | 30 | 30 | SiN | Good | Good | Good | Good |
| Example 2 | 80 | 10 | 10 | | 1.5 × $10^9$ | Adequate | Good | Good |
| Example 3 | 80 | 3 | 17 | | 1.5 × $10^9$ | Good | Good | Adequate |
| Example 4 | 37 | 3 | 60 | | 1.8 × $10^9$ | Good | Good | Adequate |
| Example 5 | 5 | 35 | 60 | | 1.8 × $10^9$ | Good | Adequate | Good |
| Example 6 | 5 | 60 | 35 | | 1.8 × $10^9$ | Good | Adequate | Good |
| Example 7 | 30 | 60 | 10 | | 1.8 × $10^9$ | Adequate | Good | Good |
| Example 8 | 60 | 20 | 20 | | Good | Good | Good | Good |
| Example 9 | 40 | 10 | 50 | | Good | Good | Good | Good |
| Example 10 | 20 | 50 | 30 | | Good | Good | Good | Good |
| Example 11 | 40 | 30 | 30 | SiCN | Good | Good | Good | Good |
| Example 12 | 80 | 10 | 10 | | 1.5 × $10^9$ | Adequate | Good | Good |
| Example 13 | 80 | 3 | 17 | | 1.5 × $10^9$ | Good | Good | Adequate |
| Example 14 | 37 | 3 | 60 | | 1.8 × $10^9$ | Good | Good | Adequate |
| Example 15 | 5 | 35 | 60 | | 1.8 × $10^9$ | Good | Adequate | Good |
| Example 16 | 5 | 60 | 35 | | 1.8 × $10^9$ | Good | Adequate | Good |
| Example 17 | 30 | 60 | 10 | | 1.8 × $10^9$ | Adequate | Good | Good |
| Example 18 | 60 | 20 | 20 | | Good | Good | Good | Good |
| Example 19 | 40 | 10 | 50 | | Good | Good | Good | Good |
| Example 20 | 20 | 50 | 30 | | Good | Good | Good | Good |

Figure 5:
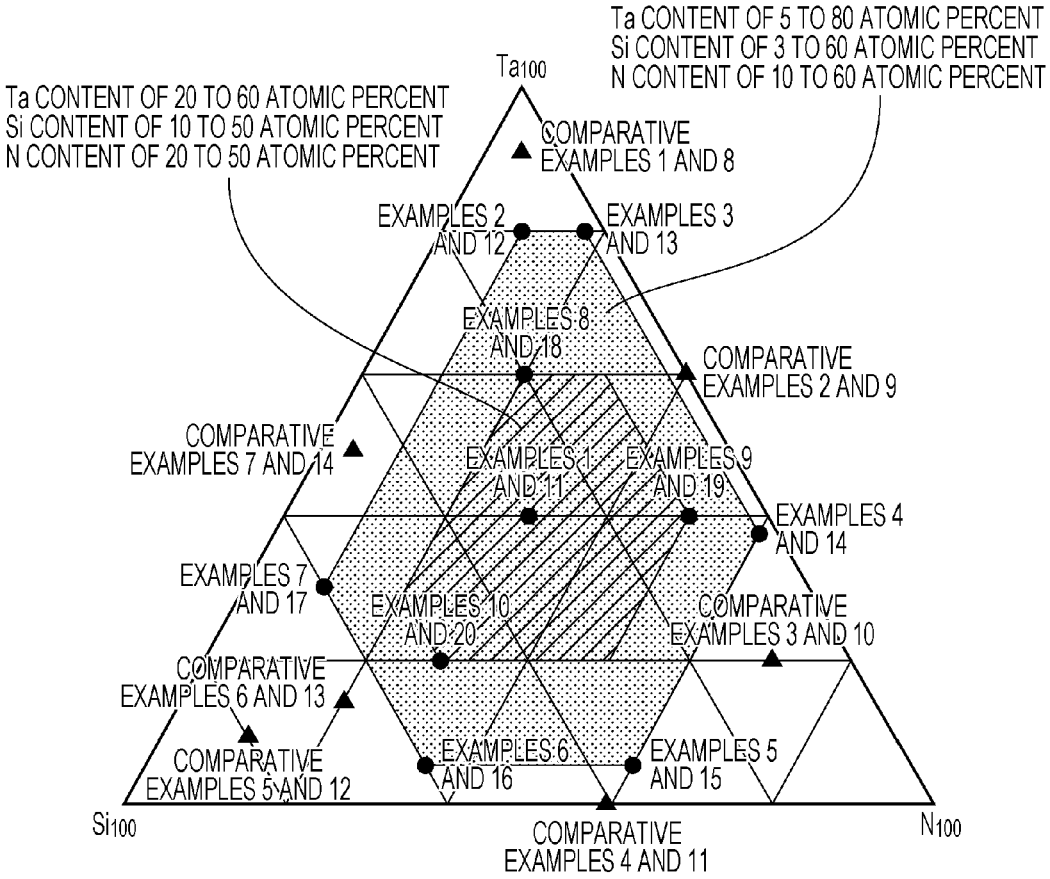
FIG. 5 is a ternary graph showing the composition of adhesive layers (intermediate layers) of inkjet head substrates manufactured in examples and comparative examples.

FIG. 5 is a ternary graph showing the composition of $Ta_xSi_yN_z$ used to form the adhesive layers 109 in Examples 1 to 20 and Comparative Examples 1 to 14.

As shown in Table 1, in the inkjet heads 410 manufactured in Comparative Examples 1, 7, 8, and 14, the upper protective layer 107, which was made from the Ir film, located under at least one of three nozzles is broken and is swollen and the adhesive layer 109 located under this upper protective layer 107 is oxidized and is swollen.

In the inkjet heads 410 manufactured in Comparative Examples 2, 3, 9, and 10, a gap is present in an end portion of the interface between the insulating protective layer 106 and the adhesive layer 109 located under one of three nozzles. In the inkjet heads 410 manufactured in Comparative Examples 3 to 6 and 10 to 13, an end portion of the interface between the adhesive layer 109 and upper protective layer 107 located under at least one of three nozzles is peeled off.

In contrast, in the inkjet heads 410 manufactured in Examples 1 to 20, the adhesive layers 109 remain unoxidized and are not peeled from the upper protective layers 107 or the insulating protective layers 106 after $1\times10^9$ voltage pulses are applied to these inkjet heads 410. Therefore, it is clear that the adhesiveness of the adhesive layers 109 is excellent.

From the results shown in Table 1, in order to achieve a long-life inkjet head capable of continuing stable discharge for a long time, $Ta_xSi_yN_z$ used to form adhesive layers 109 placed between an Ir film and a SiN or SiCN film preferably has a composition below. That is, it is preferred that x is 5 atomic percent to 80 atomic percent, y is 3 atomic percent to 60 atomic percent, z is 10 atomic percent to 60 atomic percent, and the sum of x, y, and z is 100 atomic percent. The range of this composition is indicated with halftone dots in FIG. 5. From the above results, it is clear that when the percentage of N in $Ta_xSi_yN_z$ is less than the lower limit, the adhesive layers 109 are oxidized and therefore the Ir film placed thereon is likely to be broken. Furthermore, it is clear that when the percentage of Ta in $Ta_xSi_yN_z$ is less than the lower limit, the adhesion strength of the adhesive layers 109 to the Ir film is low. It is clear that when the percentage of Si in $Ta_xSi_yN_z$ is less than the lower limit, the adhesion strength of the adhesive layers 109 to the SiN or SiCN film is low and thin film the adhesive layers 109 are likely to be peeled from the SiN or SiCN film.

As shown in Table 2, in the inkjet heads 410 manufactured in Examples 1, 8 to 11, and 18 to 20, the adhesive layers 109 remain unoxidized after $2\times10^9$ voltage pulses are applied to these inkjet heads 410. The adhesive layers 109 are not peeled from the upper protective layers 107 or the insulating protective layers 106. Therefore, it is clear that the adhesiveness of the adhesive layers 109 is excellent. From the above, in order to achieve a longer-life inkjet head, the composition of $Ta_xSi_yN_z$ used to form adhesive layers 109 is preferably adjusted such that x is 20 atomic percent to 60 atomic percent, y is 10 atomic percent to 50 atomic percent, z is 20 atomic percent to 50 atomic percent, and the sum of x, y, and z is 100 atomic percent. The range of this composition is indicated with diagonal lines in FIG. 5.

In the case of using a pigment ink or dye ink with a pH of about 5 to 11 instead of the ink used in the discharge durability test, results equivalent to those described above are obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-033647, filed Feb. 22, 2013, which is hereby incorporated by reference herein in its entirety.

What is claimed is:

1. A liquid discharge head substrate comprising:

a base;

a pair of wiring lines placed on or above the base;

a heat-generating resistive layer which is placed on or above the base, which is in contact with the wiring lines, and which has a portion corresponding to a space between the wiring lines, the portion forming an electrothermal transducer;

an insulating layer which covers the heat-generating resistive layer and the wiring lines and which contains Si;

a protective layer which covers at least one region of the insulating layer that corresponds to the electrothermal transducer and which contains Ir; and an intermediate layer which is placed between the insulating layer and the protective layer and which is in contact with the insulating layer and the protective layer, wherein the intermediate layer contains a material represented by the formula $Ta_xSi_yN_z$, where x is 5 atomic percent to 80 atomic percent, y is 3 atomic percent to 60 atomic percent, z is 10 atomic percent to 60 atomic percent, and the sum of x, y, and z is 100 atomic percent.

2. The liquid discharge head substrate according to claim 1, wherein the intermediate layer contains a material represented by the formula $Ta_xSi_yN_z$, where x is 20 atomic percent to 60 atomic percent, y is 10 atomic percent to 50 atomic percent, z is 20 atomic percent to 50 atomic percent, and the sum of x, y, and z is 100 atomic percent.

3. The liquid discharge head substrate according to claim 1, wherein the insulating layer is made of SiN or SiCN.

4. A liquid discharge head comprising:

the liquid discharge head substrate according to claim 1; and a discharge port member having a discharge port for discharging ink.

* * * * *